US006414576B1

(12) United States Patent
Nakamura et al.

(10) Patent No.: US 6,414,576 B1
(45) Date of Patent: Jul. 2, 2002

(54) MULTIPLE ELECTROMAGNETIC RELAY

(75) Inventors: Akihiko Nakamura; Shigemitsu Aoki; Yoshio Okamoto, all of Tokyo (JP)

(73) Assignee: Fujitsu Takamisawa Component Ltd., Tokyo (JP)

( * ) Notice: Subject to any disclaimer, the term of this patent is extended or adjusted under 35 U.S.C. 154(b) by 0 days.

(21) Appl. No.: 09/588,235

(22) Filed: Jun. 6, 2000

(30) Foreign Application Priority Data

Dec. 27, 1999 (JP) ..... 11-371263

(51) Int. Cl.[7] ..... H01H 51/22
(52) U.S. Cl. ..... 335/83; 335/128; 335/133
(58) Field of Search ..... 335/78–86, 124, 335/128, 132, 133

(56) References Cited

U.S. PATENT DOCUMENTS 5,216,396 A * 6/1993 Stahly ..... 335/80

FOREIGN PATENT DOCUMENTS

JP 6-78370 * 3/1994
JP 7-96826 * 4/1995

* cited by examiner

*Primary Examiner*—Lincoln Donovan
(74) *Attorney, Agent, or Firm*—Staas & Halsey LLP

(57) ABSTRACT

A multiple electromagnetic relay is disclosed which comprises at least three electromagnetic relays including electromagnetic relays of the same type or two electromagnetic relays of different types selected from electromagnetic relays of various types each including a coil and a contact unit of a different type and which is mounted in a single assembly frame adapted to be attached to a board. Those terminals of the electromagnetic relays for connection with the external conductors which are connectable with a common external conductor are coupled to each other by a coupling conductor in the area of the assembly frame, and the common external conductor is connected to one of the terminals thus coupled.

11 Claims, 4 Drawing Sheets

MULTIPLE ELECTROMAGNETIC RELAY

BACKGROUND OF THE INVENTION

1. Field of the Invention

The present invention relates to an electromagnetic relay or, in particular, to a multiple electromagnetic relay comprising a plurality of electromagnetic relays mounted in a single assembly frame.

2. Description of the Related Art

With the recent development of electric equipment and automatic operation of automotive vehicles, more and more electromagnetic relays are mounted in the vehicle to control various lamps, motors and solenoids. This has given rise to a strong demand for a simple method to mount the electromagnetic relays, in a compact form, on a base board.

An electromagnetic relay is configured with a combination of a coil and at least one contact, each contact provided in various positions between open and closed. There are four main configurations. They are a one-make electromagnetic relay having a coil and a normally open contact associated with a cantilever type armature (the contact is open when non-energized, and is closed when energized), a double-make electromagnetic relay having a coil and two normally open contacts associated with a cantilever type armature (the two contacts are open when non-energized, and are closed when energized), a transfer electromagnetic relay having a coil and a normally closed contact and a normally open contact associated with a cantilever type armature (one contact is closed and another contact is open when non-energized, and one contact is open and another contact associated with a cantilever type armature (the contact is closed when non-energized, and is open when energized).

As an example, a double electromagnetic relay comprises two transfer electromagnetic relays mounted in an assembly frame which in turn is mounted on a base board for driving the power window motor of the vehicle in the forward and reverse directions. In the double electromagnetic relay, the two transfer electromagnetic relays can be mounted in proximity to each other on the board, and therefore the required space is reduced while at the same time greatly simplifying the mounting work, as compared with the case in which two transfer electromagnetic relays are individually mounted on the board.

However, for controlling the turn signal flasher lamp and the hazard warning flasher lamp of the automotive vehicle, for example, a one-make electromagnetic relay and a double-make electromagnetic relay are required. A multiple electromagnetic relay including these two types of electromagnetic relays has yet to be developed.

SUMMARY OF THE INVENTION

In view of the problem described above, the object of the present invention is to provide a multiple electromagnetic relay other than a double electromagnetic relay including two electromagnetic relays of the same type.

According to this invention, there is provided a multiple electromagnetic relay assembly comprising at least three electromagnetic relays including relays of the same type or two electromagnetic relays of different types selected from several electromagnetic relays configured with combinations of a coil and a various number of contact units, each contact provided in varying positions between open and closed, wherein the selected combination is mounted in a single assembly frame adapted to be mounted on a base board.

A multiple electromagnetic relay thus configured comprises at least three electromagnetic relays including relays of the same type or two electromagnetic relays of different types mounted in a single assembly frame which in turn is mounted on a board.

The present invention may be more fully understood from the description of preferred embodiments of the invention set forth below, together with the accompanying drawings.

DESCRIPTION OF THE PREFERRED EMBODIMENTS

Figure 1:
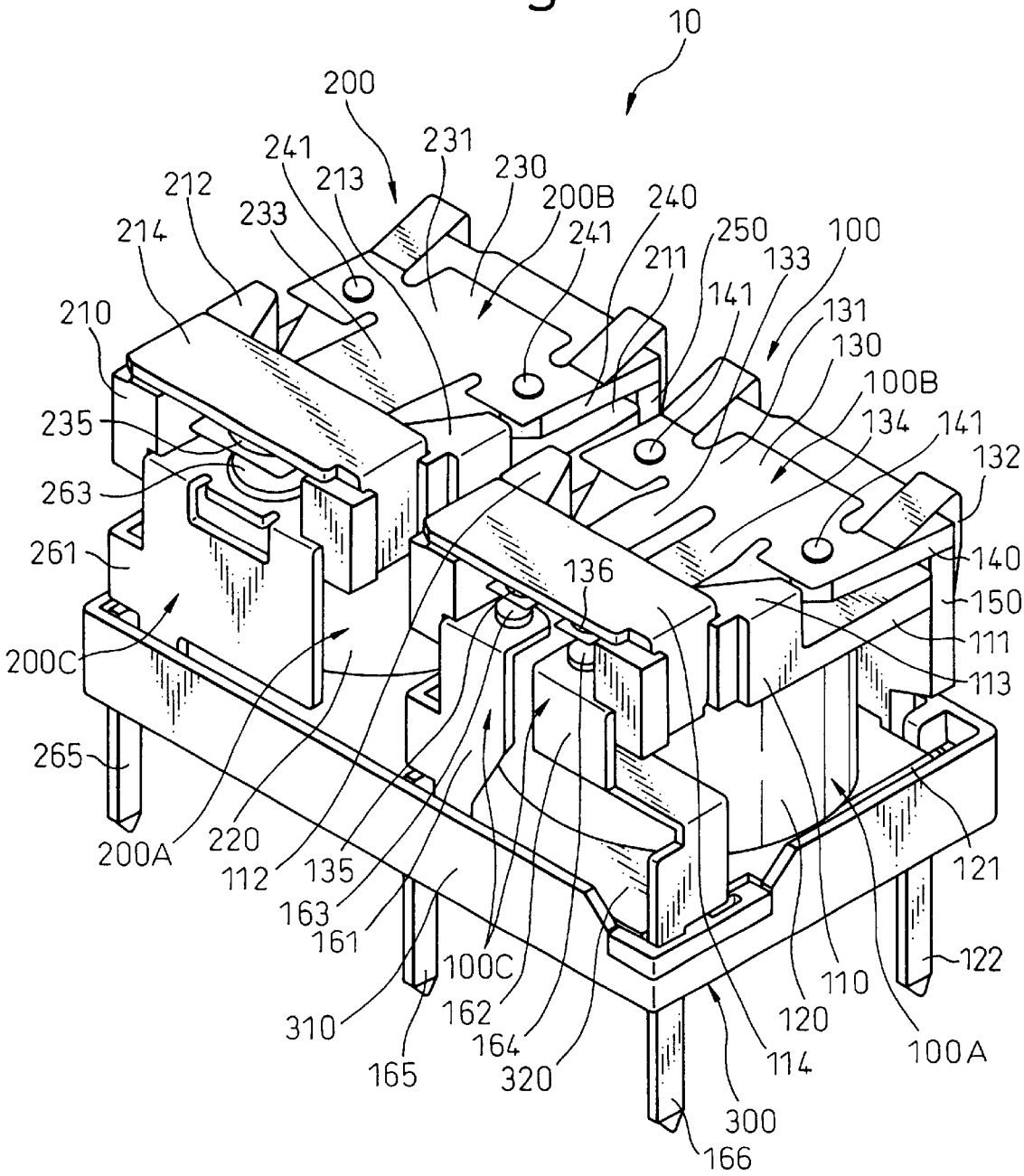
FIG. 1 is a perspective view of a double electromagnetic relay with the cover thereof removed according to a first embodiment of the invention.

FIG. 1 is a perspective view of a double electromagnetic relay 10 including a double-make electromagnetic relay 100 and a one-make electromagnetic relay 200 mounted in a single assembly frame 300 with a cover 400 (FIG. 2) removed.

The double-make electromagnetic relay 100 includes a coil unit 100A, a movable contact unit 100B and fixed contact units 100C.

In the coil unit 100A, a coil 120 is formed by winding a covered thin copper wire on a coil bobbin 110 formed in such a manner as to cover an iron core (not shown) with resin. The coil bobbin 110 has a flat plate portion 111 extending to the upper right and two thick arms 112, 113 extending to the lower left. A bridge 114 of a copper alloy substantially in the shape of a channel with a downward opening is suspended over the two arms 112, 113.

The movable contact unit 100B includes a spring member 130 of a thin copper alloy plate having a horizontal portion 131 and a vertical portion 132, a magnetic force receiving member 140 of iron coupled to the lower side of the horizontal portion 131 of the spring member 130 for receiving the magnetic force generated in the coil 120, and a vertical support member 150 of iron with the outer side thereof coupled with the vertical portion 132 of the spring member 130.

The horizontal portion 131 of the spring member 130 and the magnetic force receiving member 140 are coupled to each other in such a manner that holes formed in the spring member 130 are fitted on the heads of dowels 141 formed on the magnetic force receiving unit 140, and the heads of the dowels 141 are crushed. Though not shown, the vertical portion 132 of the spring member 130 and the vertical support member 150 are also coupled to each other in similar manner.

The horizontal portion 131 of the spring member 130 has two arms 133, 134 extending to the lower left. Contact protrusions 135, 136 made of a material high in electrical corrosion resistance are fixed at the forward end of the arms 133, 134 and protruded downward, though not shown.

The fixed contact units 100C include two copper alloy conductors 161, 162 fixedly embedded while forming the two arms 112, 113 of the coil bobbin 110. Contact protrusions 163, 164 of a material high in electrical corrosion resistance adapted to contact the contact protrusions 135, 136 mounted on the two arms 133, 134 of the spring member 130 of the movable unit 100B are fixed on the top of the conductors 161, 162.

The double-make electromagnetic relay 100 is configured as described above, so that when the coil 120 is not energized, the spring member 130 of the movable contact unit 100B is warped upward, so that the contact protrusions 135, 136 mounted on the two arms 133, 134 of the spring member 130 and the contact protrusions 163, 164 fixed on the two conductors 161, 162 of the fixed contact units 100C are not in contact and no current can flow.

Upon generation of the electromagnetic force with the current supplied to the coil 120, the magnetic force receiving member 140 of the movable contact unit 100B is attracted downward, with the result that the contact protrusions 135, 136 of the movable contact unit 100B come into contact with the contact protrusions 163, 164 of the fixed contact units 100C so that current can flow between them.

The one-make electromagnetic relay 200 basically has the same configuration as the double-make electromagnetic relay 100, and includes a coil unit 200A, a movable contact unit 200B and a fixed contact unit 200C. In the coil unit 200A, a coil 220 is formed by winding a thin covered copper wire on the coil bobbin 210 formed in such a manner as to cover an iron core (not shown) with resin. The coil bobbin 210 has a flat plate portion 211 extending to the upper right and two thick arms 212, 213 extending to the lower left. A bridge 214 substantially in the shape of a downwardly-open channel of a copper alloy is suspended over the two arms 212, 213.

The movable contact unit 200B is made of a thin copper alloy plate and includes a spring member 230 having a horizontal portion 231 and a vertical portion 232, a magnetic force receiving member 240 of iron coupled to the lower side of the horizontal portion 231 of the spring member 230 for receiving the magnetic force generated in the coil 220, and a vertical support member 250 of iron with the outside thereof coupled to the vertical portion 232 of the spring member 230.

The horizontal portion 231 of the spring member 230 and the magnetic force receiving member 240 are coupled to each other in such a manner that holes formed in the spring member 230 are fitted on the heads of the dowels 241 formed on the magnetic force receiving unit 240, and the heads of the dowels 241 are crushed. Though not shown, the vertical portion 232 of the spring member 230 and the vertical support member 250 are also coupled to each other in similar manner.

The horizontal portion 231 of the spring member 230 has an arm 233 extending to the lower left. A contact protrusion 235 made of a material high in electric corrosion resistance is fixed at the forward end of the arm 233 and protruded downward, though this is not shown.

The fixed contact unit 200C includes a conductor 261 of a copper alloy fixedly embedded when forming the two arms 212, 213 of the coil bobbin 210. A contact protrusion 263 made of a material high in electrical corrosion resistance, and mounted adapted to contact the contact protrusion 235 mounted on the arm 233 of the spring member 230 of the movable contact unit 200B, is fixed on the top of the fixed contact unit 200C.

The one-make electromagnetic relay 200 is configured as described above and, like the double-make electromagnetic relay 100, the the spring member 230 of the movable contact unit 200B is warped upward when no current is supplied to the coil 220. The contact protrusion 235 mounted on the arm 233 of the spring member 230 and the contact protrusion 263 fixed on the conductor 261 of the fixed contact unit 200C are in spaced relation to each other and no current can flow between them.

Upon generation of electromagnetic force with current supplied to the coil 220, on the other hand, the magnetic force receiving member 240 of the movable unit 200B is attracted downward, with the result that the contact protrusion 235 of the movable contact unit 200B comes into contact with the contact protrusion 263 of the fixed unit 200C and a current can flow between them.

The assembly frame 300 includes a frame portion 310 and a bottom plate 320. The iron core (not shown) of the coil 120 of the double-make electromagnetic relay 100 and the iron core (not shown) of the coil 220 of the one-make electromagnetic relay 200 are fixed on the bottom plate 320.

Terminals 165, 166 are formed integrally with conductors 161, 162 of the fixed contact unit 100C of the double-make electromagnetic relay 100 through the bottom plate 320 of the assembly frame 300, and a terminal 265 is formed integrally with the conductor 261 of the fixed unit 200C of the one-make electromagnetic relay 200. The terminals 165, 166 and 265 are extended downward.

Also, the terminal 151 coupled to the vertical support plate 150 of the double-make electromagnetic relay 100 extends downward through the bottom plate 320 of the assembly frame 300, and the terminal 251 coupled to the vertical support plate 250 of the one-make electromagnetic relay 200 is extended downward through the bottom plate 320 of the assembly frame 300.

Figure 3:
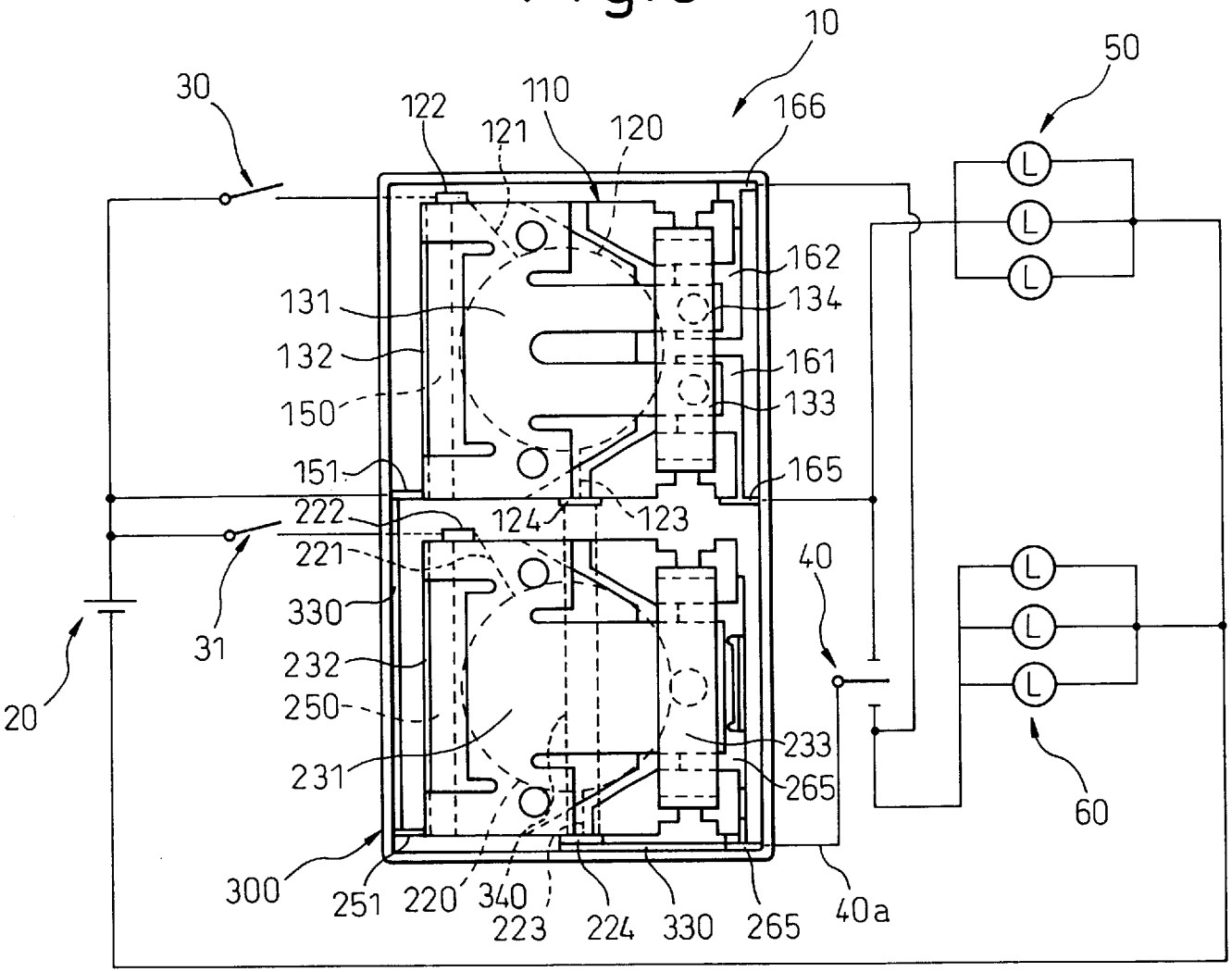
FIG. 3 is a circuit diagram of a winker and hazard warning flash lamp control system using the double electromagnetic relay according to the first embodiment.

The terminals 151 and 251 are connected to each other by a coupling conductor 330 in the assembly frame 300 as described later (FIG. 3).

Further, a terminal 122 connected with one terminal 121 of the covered conductor wound as a coil 120 of the double-make electromagnetic relay 100 and a terminal 124 connected with the other terminal 123 are extended downward through the bottom plate 320 of the assembly frame 300. In similar fashion, a terminal 222 connected with one terminal 221 of the covered conductor wound as a coil 220 of the one-make electromagnetic relay 200 and a terminal 224 connected with the other terminal 223 are extended downward through the bottom plate 320 of the assembly frame 300. Among these terminals, the terminals 124 and 224 are connected to each other by a coupling conductor 340 in the assembly frame 300 as described later (FIG. 3).

Figure 2:
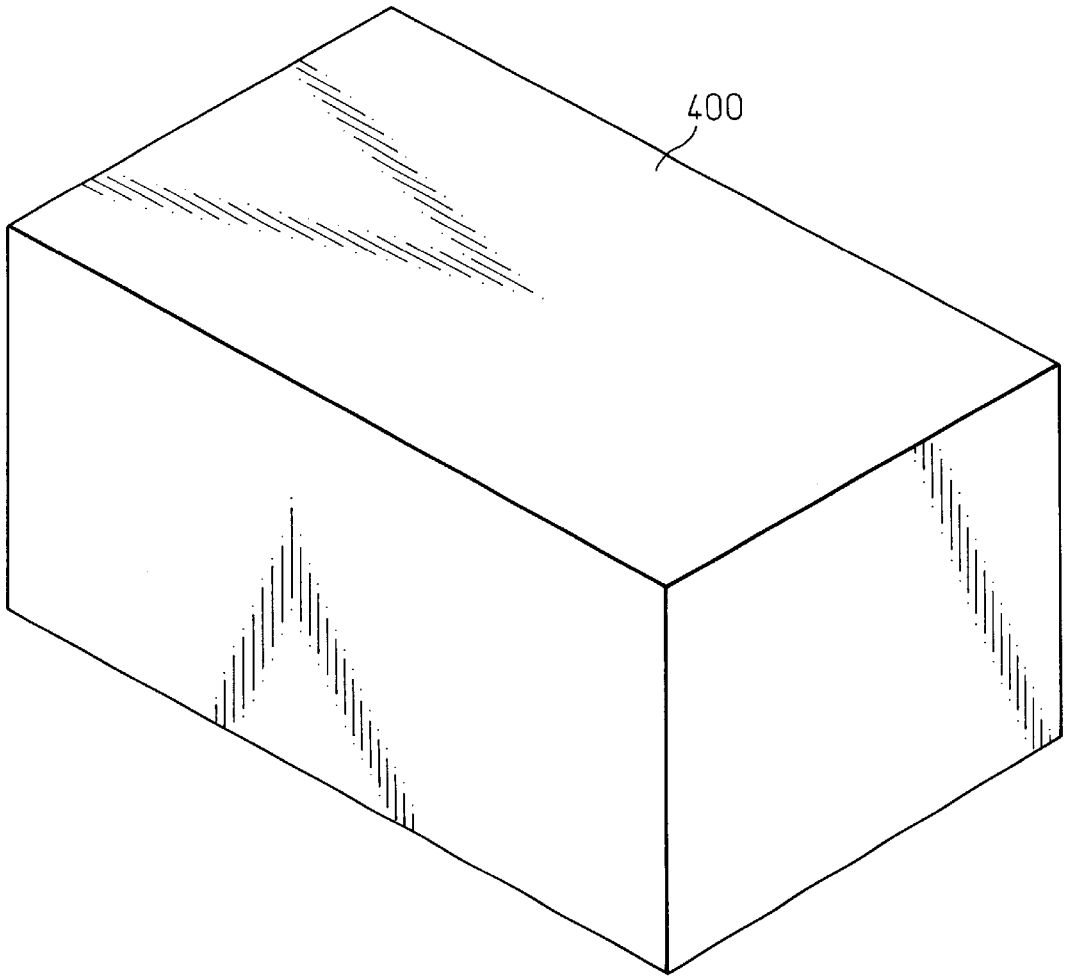
FIG. 2 is a perspective view of the cover according to the first embodiment.

FIG. 2 shows a cover 400 for protecting the whole of the one-make electromagnetic relay 100 and the double-make electromagnetic relay 200 mounted on the assembly frame 300. A product is completed when this cover 400 is attached.

FIG. 3 is a circuit diagram of the double electromagnetic relay 10 including a combination of the double-make electromagnetic relay 100 and the one-make electromagnetic relay 200 used for controlling the winker and the hazard lamps of the vehicle. The double electromagnetic relay 10 is shown as a top plan view with the cover 400 removed. Only the minimum required reference numerals are attached to simplify the diagram.

The terminal 151 formed integrally with the vertical support plate 150 of the double-make electromagnetic relay 100 is connected to the positive side of a storage battery 20. The terminal 151 is coupled to the terminal 251 formed integrally with the vertical support plate 250 of the one-make electromagnetic relay 200 by a coupling conductor 330.

The terminal 122 connected with one end 121 of the conductor of the coil 120 of the double-make electromagnetic relay 100 is connected to the positive side of the storage battery 20 through a switch 30 passing the flash on/off current. In similar fashion, the terminal 222 connected with one end 221 of the coil 220 of the one-make electromagnetic relay 200 is connected to the positive side of the storage battery 20 through a switch 31 for passing the flash on/off current.

Numeral 40 designates a turn signal flasher switch manipulated by the driver, numeral 50 lamps arranged in the right turn signal, and numeral 60 lamps arranged in the left turn signal, for example, of the vehicle. These component parts are connected, as shown, to the terminals 165, 166 formed integrally with the conductors 161, 162 of the fixed contact units 100C of the double-make electromagnetic relay 100 and the terminal 265 formed integrally with the conductor 261 of the fixed contact unit 200C of the one-make electromagnetic relay 200.

Also, the terminal 124 of the covered conductor of the coil 120 of the double-make electromagnetic relay 100, which terminal is connected with the end 123 far from the end 121 of the covered conductor connected with the battery 20, is connected through the coupling conductor 340 to the end 224 of the covered conductor of the coil 220 of the one-make electromagnetic relay 200, which end is far from the end 221 of the covered conductor connected with the battery 20. The terminal 224 is connected to the ground, and so is the terminal 124.

Thus, the terminal 124 of the double-make electromagnetic relay 100 is not required to be connected to the ground independently, nor is the terminal 251 of the one-make electromagnetic relay 200 required to be independently connected to the battery 20. As a result, the circuit wiring of the board can be simplified and the number of the assembly steps can be decreased correspondingly.

The foregoing description concerns a double electromagnetic relay comprising a double-make electromagnetic relay and a one-make electromagnetic relay mounted in a single assembly frame. In similar manner, it is, of course, possible to produce a double electromagnetic relay comprising two different types of electromagnetic relays selected from a double-make electromagnetic relay, a transfer electromagnetic relay, a one-make electromagnetic relay and a one-break electromagnetic relay, mounted in a single assembly frame. In accordance with the circuit specification, the terminals can also be coupled to each other.

The terminals 124, 251 are normally formed to extend, together with other terminals, by a predetermined length to the far side of the electromagnetic relay on the bottom plate 320 of the assembly frame 300. This configuration can be employed as it is, or the terminals 124, 251 can be cut off before or after being mounted on the board in such a manner as not to extend beyond the surface of the bottom plate 320 (the surface on the far side of the electromagnetic relay), or can be formed in advance not to extend beyond the surface of the bottom plate 320 (the surface on the far side of the electromagnetic relay).

Figure 4:
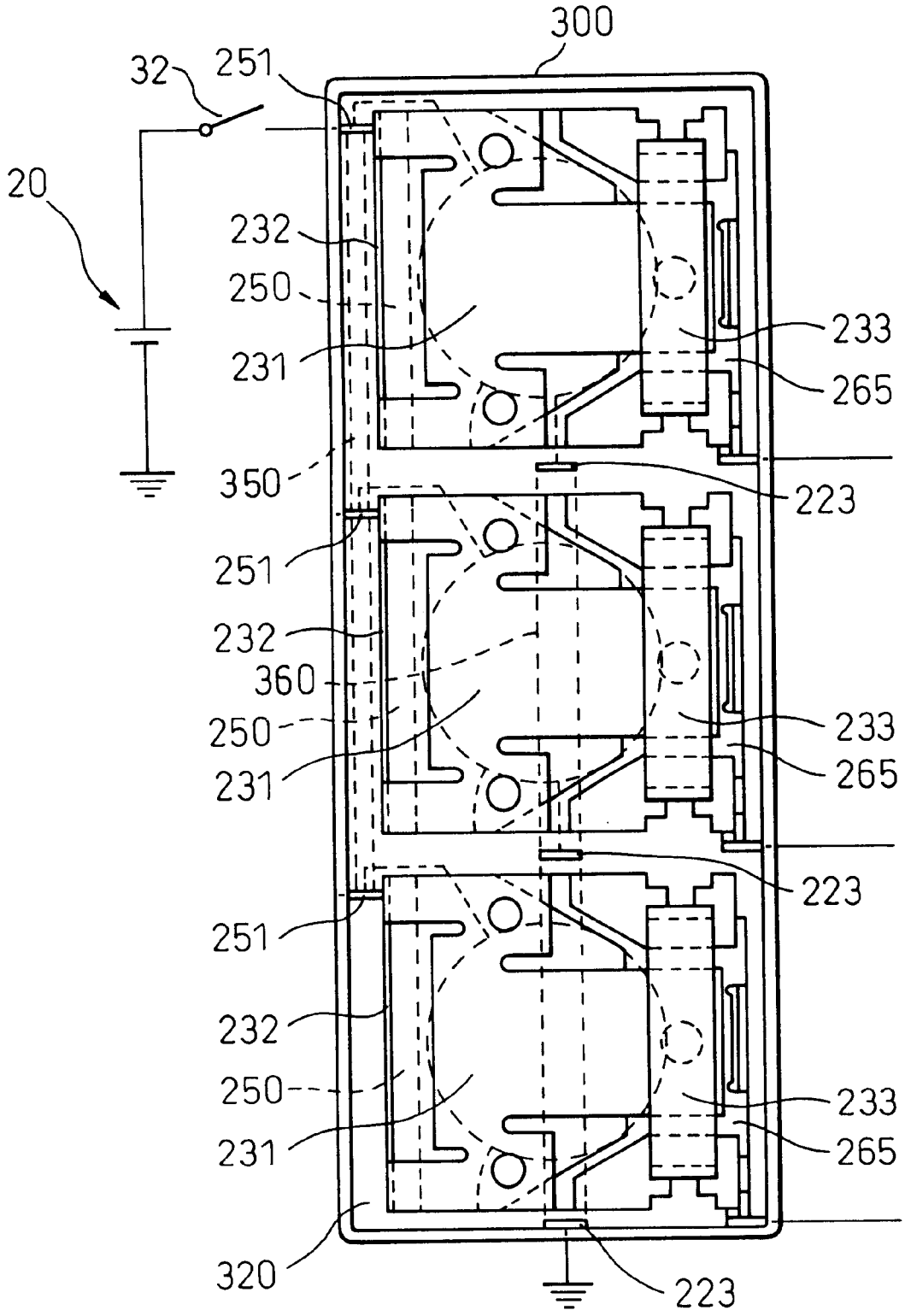
FIG. 4 is a partial circuit diagram of a control system using a triple electromagnetic relay according to a second embodiment.

A second embodiment will be explained with reference to FIG. 4. The second embodiment concerns a triple electromagnetic relay comprising an arrangement of three one-make electromagnetic relays 200. Although the application of this electromagnetic relay is not specifically limited, the terminal 251 of each one-make electromagnetic relay 200 and an end 221 of the coil 220 can be connected to the positive side of the battery 20, and the other end 223 of the coil 220 can be connected to the ground.

In view of this, the terminal 251 of the one-make electromagnetic relay 200 shown in the upper stage, the terminal 251 of the one-make electromagnetic relay 200 shown in the middle stage and the terminal 251 of the one-make electromagnetic relay 200 shown in the lower stage are coupled to each other by a coupling member 350 on the back of the bottom plate 320 of the assembly frame 300. Thus, it is sufficient to connect only one of the three terminals 251 to the battery 20. In the diagram, the terminal 251 of the one-make electromagnetic relay 200 in the upper stage is connected through the switch 32 to the battery 20.

In similar fashion, the terminal 223 of the one-make electromagnetic relay 200 shown in the upper stage, the terminal 223 of the one-make electromagnetic relay shown in the middle stage and the terminal 223 of the one-make electromagnetic relay 200 shown in the lower stage are coupled to each other by a coupling member 360 on the back of the bottom plate 320 of the assembly frame 300. Thus, it is sufficient to connect only one of the three terminals 223 to the ground. In the diagram, the terminal 223 of the one-make electromagnetic relay 200 in the lower stage is connected to the ground.

The terminals 265 of the one-make electromagnetic relays 200 are connected separately to the devices not shown.

In the second embodiment configured as described above, the terminals are not required to be connected individually, so that the wiring in the board not shown can be simplified and the number of steps for assembling the equipment used in the triple electromagnetic relay can be remarkably reduced. Also, apart from the one-make electromagnetic relay described above, the one-break electromagnetic relay or other types of electromagnetic relays can be mounted in the assembly frame 300 with equal effect.

According to this invention, at least three electromagnetic relays including relays of the same type or two electromagnetic relays of different types can be mounted in one assembly frame, which is attached to the board. Therefore, a multiplicity of electromagnetic relays can be mounted easily on the board in a compact way.

While the invention has been described by reference to specific embodiment chosen for the purpose of illustration, it should be apparent that numerous modifications could be made thereto by those skilled in the art without departing from the basic concept and scope of the invention.

What is claimed is:

1. A multiple electromagnetic relay assembly comprising:

at least three electromagnetic relays including electromagnetic relays of the same type or at least two electromagnetic relays of a different type selected from among several different types of electromagnetic relays each including a coil and at least one contact provided in various positions between open and closed; and terminals extending therefrom to be connected to external conductors of each electromagnetic relay, wherein said electromagnetic relays are mounted in a single assembly frame, and wherein terminals connected with each other through a common external conductor are coupled to each other by a coupling conductor within said single assembly frame, and said common external conductor is connected to one of said terminals.

2. A multiple electromagnetic relay assembly according to claim 1, wherein said at least three electromagnetic relays include electromagnetic relays of the same type or at least two electromagnetic relays of a different type selected from a one-make electromagnetic relay, a double-make electromagnetic relay, a transfer electromagnetic relay, and a one-break electromagnetic relay, said selected electromagnetic relays being mounted in said assembly frame and extending therefrom to be connected to a board.

3. A multiple electromagnetic relay assembly according to claim 2, wherein said at least three electromagnetic relays include a double electromagnetic relay comprising a double-make electromagnetic relay and a one-make electromagnetic relay mounted within said single assembly frame.

4. A multiple electromagnetic relay assembly according to claim 2, wherein said at least three electromagnetic relays include a double electromagnetic relay comprising a double-make electromagnetic relay and a transfer electromagnetic relayed mounted within said single assembly frame.

5. A multiple electromagnetic relay assembly according to claim 2, wherein said at least three electromagnetic relays include a double electromagnetic relay comprising a one-make electromagnetic relay and a transfer electromagnetic relay mounted within said single assembly frame.

6. A multiple electromagnetic relay assembly according to claim 1, wherein said coupling conductor includes at least one of:

a moving part connected terminal coupling conductor coupling the terminals connected to a moving part of a cantilever type contact of each electromagnetic relay;

a fixed part connected terminal coupling conductor coupling the terminals connected to a fixed part of a cantilever type contact of each electromagnetic relay; and a coil terminal coupling conductor for coupling the coil terminals of each electromagnetic relay.

7. A multiple electromagnetic relay assembly according to claim 1, wherein each of said electromagnetic relays is mounted on a first side of a bottom plate of the assembly frame, and each terminal extends from one of said conductors of each said electromagnetic relay to a second side of said bottom plate.

8. A multiple electromagnetic relay assembly according to claim 7, wherein said coupling conductor is arranged on the second side of said bottom plate.

9. A multiple electromagnetic relay assembly according to claim 7, where those terminals coupled by the coupling conductor which are not connected with an external conductor are formed to protrude from the second side of the bottom plate of the assembly frame, and said terminals are cut off, such that they do not protrude from the second side of the bottom plate, before or after the electromagnetic relay assembly is mounted on the board.

10. A multiple electromagnetic relay assembly according to claim 7, wherein those terminals coupled by the coupling conductor which are not connected with an external conductor are preformed not to protrude from the second surface of the bottom plate of the assembly frame.

11. A multiple electromagnetic relay assembly comprising:

at least three electromagnetic relays including relays of the same type or at least two relays of a different type selected from several different types of relays; and terminals extending from said relay assembly being connected to external conductors of each relay such that the terminals connected with each other through a common external conductor are coupled to each other by a coupling conductor.

* * * * *